US009580082B2

(12) United States Patent
Chedal Bornu

(10) Patent No.: US 9,580,082 B2
(45) Date of Patent: Feb. 28, 2017

(54) MECHANICAL LIFT VEHICLE

(71) Applicant: SOMMITAL, Chambery (FR)

(72) Inventor: Yves Chedal Bornu, Bozel (FR)

(73) Assignee: SOMMITAL, Chambery (FR)

( * ) Notice: Subject to any disclaimer, the term of this patent is extended or adjusted under 35 U.S.C. 154(b) by 259 days.

(21) Appl. No.: 14/358,772

(22) PCT Filed: Oct. 30, 2012

(86) PCT No.: PCT/FR2012/052513
§ 371 (c)(1),
(2) Date: May 16, 2014

(87) PCT Pub. No.: WO2013/072596
PCT Pub. Date: May 23, 2013

(65) Prior Publication Data

US 2015/0000548 A1 Jan. 1, 2015

(30) Foreign Application Priority Data

Nov. 16, 2011 (FR) ..... 11 60422

(51) Int. Cl.
*B61B 12/00* (2006.01)
*B61B 11/00* (2006.01)

(52) U.S. Cl.
CPC ..... *B61B 12/002* (2013.01); *B61B 11/00* (2013.01)

(58) Field of Classification Search
CPC ..... B61B 12/00; B61B 12/002; B61B 12/028
(Continued)

(56) References Cited

U.S. PATENT DOCUMENTS 6,494,145 B2 * 12/2002 Kernan ..... B61B 12/028 104/28
6,520,573 B2 2/2003 Österle
(Continued)

FOREIGN PATENT DOCUMENTS

CH EP 2810841 A1 * 12/2014 ..... B61B 12/002
CN 1955052 A 5/2007
(Continued)

OTHER PUBLICATIONS

International Search Report issued Dec. 20, 2012 re: PCT/FR2012/052513; citing: FR 2 950 847 A3, EP 2 030 858 A2, EP 1 671 867 A1 and DE 295 17 263 U1.

*Primary Examiner* — Jason C Smith
(74) *Attorney, Agent, or Firm* — Cantor Colburn LLP

(57) ABSTRACT

This vehicle includes a guard rail intended to occupy a lowered position delimiting a closed space that prevents a passenger from falling and a raised position in which the guard rail opens up the space at the front of the vehicle to allow one or more passengers to board and disembark. The vehicle also includes means for locking the guard rail in the lowered position, wherein the locking means includes a locking lever having a first end provided with a bearing surface and with a blocking surface, the bearing surface and the blocking surface delimiting a first housing intended to accommodate part of the guard rail, and a second end in which a locking member designed to immobilize the second end of the locking lever is intended to engage when the guard rail is in the lowered position.

13 Claims, 4 Drawing Sheets

(58) Field of Classification Search
USPC ..... 104/173.1, 173.2
See application file for complete search history.

(56) References Cited

U.S. PATENT DOCUMENTS

| | | | | |
|---|---|---|---|---|
| 8,938,998 | B2 * | 1/2015 | Haber | E05B 47/0038 292/251.5 |
| 2009/0115204 | A1 * | 5/2009 | Rycroft | E05B 63/20 292/341.17 |
| 2013/0269567 | A1 * | 10/2013 | Chedal Bornu | B61B 12/002 105/149.2 |
| 2015/0000548 | A1 * | 1/2015 | Chedal Bornu | B61B 11/00 104/173.2 |
| 2015/0197256 | A1 * | 7/2015 | Chedal Bornu | B61B 12/06 105/149.2 |
| 2016/0031452 | A1 * | 2/2016 | Chedal Bornu | B61B 12/002 104/112 |

FOREIGN PATENT DOCUMENTS

| | | | |
|---|---|---|---|
| CN | 101712322 | A | 5/2010 |
| DE | 29517263 | U1 | 4/1997 |
| EP | 1671867 | A1 | 6/2006 |
| EP | 2030858 | A2 | 3/2009 |
| FR | 2950847 | | 4/2011 |
| JP | 2000279938 | A | 10/2000 |
| JP | 2006168725 | A | 6/2006 |
| JP | 2009057040 | A | 3/2009 |
| JP | 2014503413 | A | 2/2014 |
| JP | 2015525172 | A | 9/2015 |
| RU | 2008126089 | A | 1/2010 |
| RU | 2009134968 | A | 3/2011 |

* cited by examiner

MECHANICAL LIFT VEHICLE

FIELD

The present disclosure relates to a mechanical lift vehicle comprising means for locking a guard rail, and a mechanical lift facility equipped with said vehicle.

BACKGROUND

Conventionally, a mechanical lift facility allows passengers, skiers or pedestrians to go up or down slopes. A mechanical lift facility usually has two end stations, a station located downslope and a station located upslope. These end stations are connected by an aerial carrier-tractor cable which may form a closed loop. It is known to drive the cable by means of pulleys and to support it using pylons. Cable-suspended vehicles allow passengers to be conveyed from one end station to another.

There are several types of mechanical facility, such as chair lifts, ski-lifts, gondolas or cable cars. A chair lift-type mechanical lift facility allows passengers to go up or down a slope, in a sitting position, by means of seats suspended from a continuously moving cable.

When the cable forms a closed loop, each end station may include a passenger boarding area and a passenger disembarking area. The mechanical lift facility makes it thus possible to simultaneously transport passengers going up and down the slope.

Conveying passengers up and down a slope requires meeting a high level of security. In particular, the seats travel at a relatively large distance from the ground. It is known to improve passenger safety by using a guard rail to limit the risk of accidental falling of a passenger from the seat.

Guard rails are conventionally pivotally mounted relative to the seat to allow passengers to board and disembark. The guard rail may be in a lowered operating position or in a raised operating position. When the guard rail is in a lowered position, it constitutes an obstacle to tilting of a passenger in a vacuum. This lowered position of the guard rail is usually adopted during a phase path of the seat outside boarding and disembarking areas. When the guard rail is in a raised position, it opens up the space at the front of the seat to allow passengers to settle on the seat or leave it. The guard rail is thus normally in a raised position when the seat is in a boarding or disembarking area.

For security reasons, the guard rail must not be raised during the entire phase path outside the boarding and disembarking areas. It is, thus, known to provide the seats with means for locking their guard rail in the lowered position.

However, most means used to lock the guard rail are of the mechanical type and often require a complex structure. Consequently, said locking means do not always offer the possibility to be mounted on preexisting seats. In addition, they sometimes require substantial maintenance and can significantly weigh down the seat to which they are fitted, which often leads to premature wear of the seats and mechanical lift facilities to which they are fitted.

SUMMARY

Therefore, a solution for locking the guard rail by cooperation of a magnetic member with a magnetizable member has been developed. This solution offers the advantage of a simple, lightweight structure requiring little maintenance and adaptable to preexisting seats.

However, the mechanical lift facility fitted with these seats with means for magnetically locking the guard rail must be adapted to allow the operation of the magnetic locking means of the guard rail.

Therefore, the present disclosure aims to overcome some or all of these drawbacks by providing a mechanical lift seat with means for locking the guard rail of a simple, lightweight structure and easily adaptable to preexisting seats, and a mechanical lift facility equipped with this seat.

To this end, the present disclosure relates to a mechanical lift vehicle comprising a guard rail intended to occupy a lowered position delimiting a closed space that prevents a passenger from falling and a raised position in which the guard rail opens up the space at the front of the vehicle to allow one or more passengers to board or disembark, and means for locking the guard rail in the lowered position, wherein the locking means comprise a latch comprising a first end provided with a bearing surface and with a blocking surface, the bearing surface and the blocking surface delimiting a first housing intended to accommodate part of the guard rail, and a second end in which a locking member arranged to immobilize the second end of the latch is intended to engage when the guard rail is in the lowered position.

Thus, the mechanical lift seat according to the disclosure makes it possible to lock the guard rail mechanically in its lowered position. Locking is achieved by inserting the guard rail member in the housing located at the first end of the latch and immobilizing the second end of the latch (and thus the totality of this latch) by the locking member when the guard rail is in the lowered position. Thus, the guard rail member remains trapped in the housing and the guard rail is consequently locked in its lowered position.

According to a characteristic of the mechanical lift vehicle according to the disclosure, the second end comprises a second housing intended to cooperate with the locking member.

This second housing makes it possible to engage the locking member to immobilize the latch.

The second end of the latch may further comprise a concave wall located above the second housing.

The concave wall is intended to come in abutment against the locking member to facilitate engagement of the locking member and the second end of the latch.

According to one embodiment, the locking member is movable relative to the vehicle and comprises a first torsion spring having a free end intended to engage the second housing.

Advantageously, a stop is arranged on the trajectory of the free end.

The stop allows stopping the stroke of the free end. Thus, the stop makes it possible to position this free end for its engagement in the second housing. Moreover, it allows arming the first torsion spring to immobilize the latch.

According to a characteristic of the mechanical lift vehicle according to the disclosure, the locking means comprise means for controlling the locking member.

The control means make it possible to actuate the locking member in order to immobilize or on the contrary allow the latch to be moved. The control means may be automatic, that is to say, actuated without direct intervention of the user, or manual, that is to say, by direct intervention of the user.

According to one possibility, the control means comprise a lever fastened to the locking member, a movable control member connected to a hanger of the vehicle, and a mechanical control cable connected to the lever and to the movable control member.

Thus, the movement of the movable control member causes the movement of the mechanical control cable which transmits the movement to the lever. The movement of the lever causes the movement of the locking member.

According to one embodiment, the movable control member comprises a control latch comprising a first end on which the mechanical control cable is fixed and a second end on which a bearing member is fastened.

The bearing member may be a roller pivotally mounted on the second end.

The hanger may comprise a stop arranged on the trajectory of the second end.

Advantageously, the first end of the latch forms a hook.

This facilitates the blocking of the guard rail member inside the first housing. The second end of the latch may also form a hook for blocking the latch by the locking member.

The blocking surface may comprise a flange.

According to another characteristic of the mechanical lift vehicle according to the disclosure, the latch comprises return means to maintain it in a position to receive the guard rail member in which the first housing is arranged to receive the guard rail member.

According to one embodiment, the latch is located beneath the vehicle.

In addition, the guard rail member may be a pin integral with a footboard of the guard rail.

According to another aspect of the present disclosure, it also relates to a mechanical lift facility comprising a mechanical lift vehicle having the above characteristics.

The mechanical lift facility may comprise at least one first ramp and at least one second ramp fastened to a fixed structure of the mechanical lift facility and intended to actuate the control means of the locking member.

Each first ramp and each second ramp may be arranged on the trajectory of the second end of the control latch and shaped to cause rotation of the control latch.

Advantageously, each first ramp and each second ramp comprise at least one oblique portion for actuating the control means.

Each oblique portion is arranged on the trajectory of the roller to cause rotation of the control latch.

BRIEF DESCRIPTION OF THE FIGURES

Other features and advantages of the present disclosure will become clear from the following description of a particular embodiment of the disclosure, given by way of non-limiting example, with reference to the accompanying drawings wherein.

DETAILED DESCRIPTION OF THE FIGURES

Figure 1:
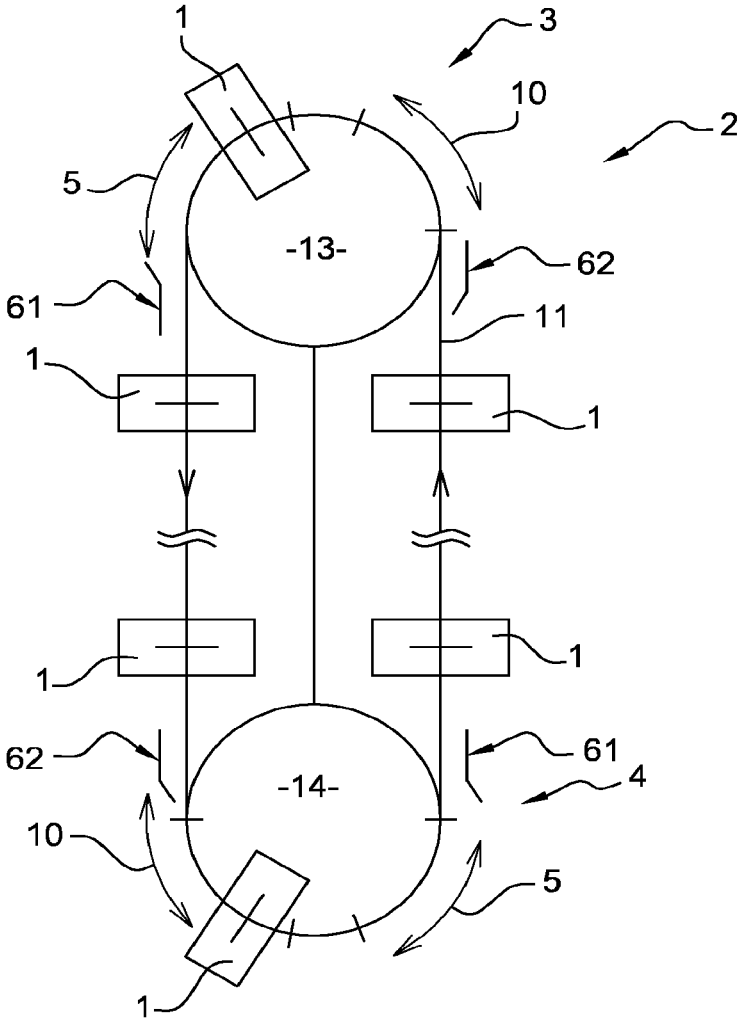
FIG. 1 is a schematic top view of a mechanical lift facility comprising mechanical lift seats according to one embodiment.

FIG. 1 shows a plurality of a mechanical lift vehicle, for example mechanical lift seats 1, equipping a mechanical lift facility 2.

The mechanical lift facility 2 comprises herein two end stations 3, 4. Each end station 3, 4 may include a passenger boarding area 5 a passenger disembarking area 10. The mechanical lift seats 1 are suspended from an aerial cable 11, tractor via a hanger 12. The cable 11 is carried by pylons, not shown in the various figures. The cable 11 here forms a closed loop and is driven by pulleys 13, 14.

Figure 2:
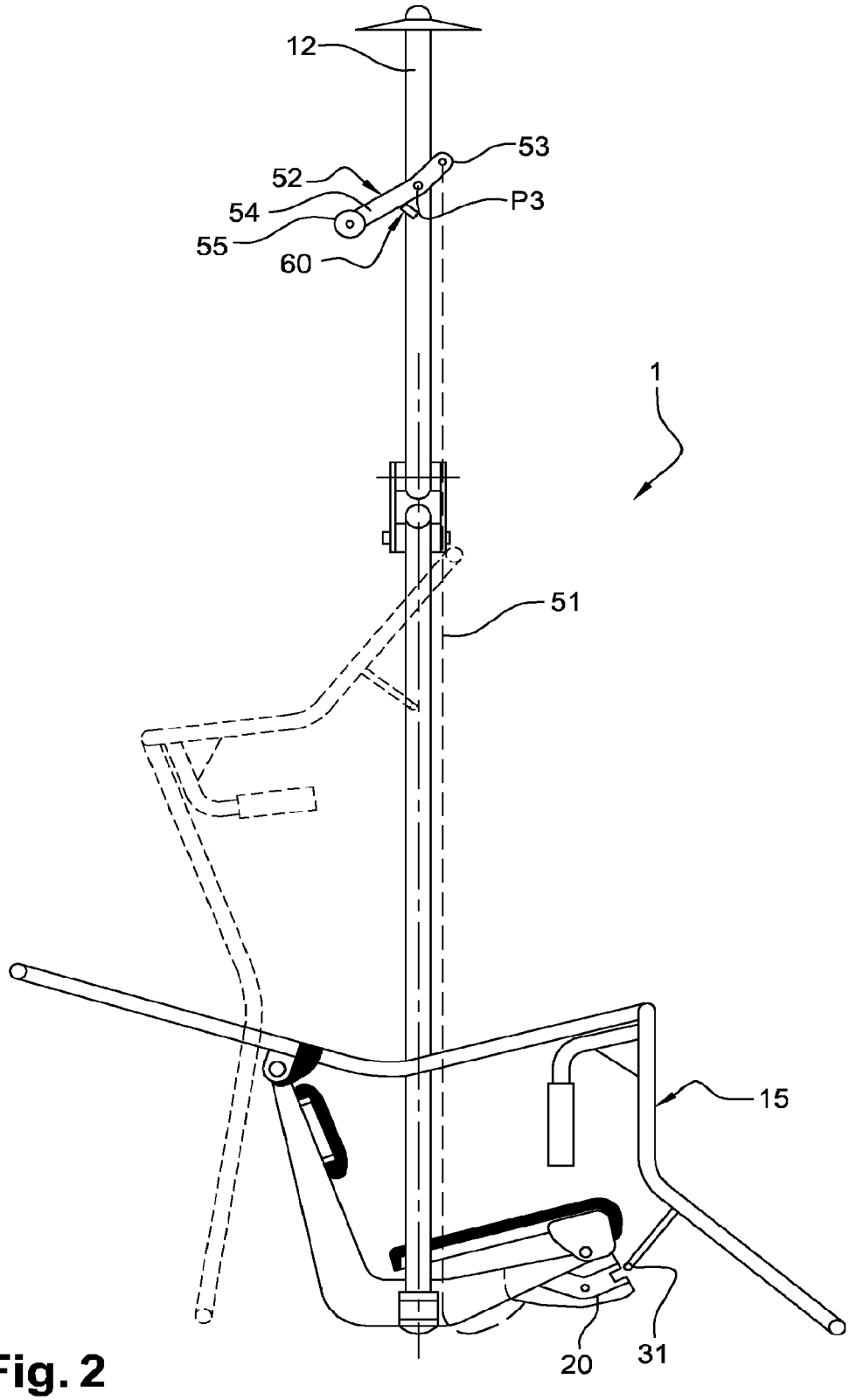
FIG. 2 is a side view of a mechanical lift vehicle according to one embodiment.

As shown in FIG. 2, the mechanical lift seat 1 comprises a guard rail 15. The guard rail 15 is pivotally mounted relative to the seat 1, and may occupy a lowered extreme position delimiting a closed space that prevents a passenger from falling and a raised extreme position in which the guard rail 15 opens up the space at the front of the seat 1 to allow one or more passengers to disembark (shown in dotted lines in the example of FIG. 2). In the example of FIG. 2, the guard rail 15 (in solid lines) is located in an intermediate position between the raised position and the lowered position.

The seat 1 also comprises means for mechanically locking the guard rail 15. The mechanical locking means comprise a latch 20 and a locking member of the latch 20, namely a first torsion spring 21.

Figure 3:
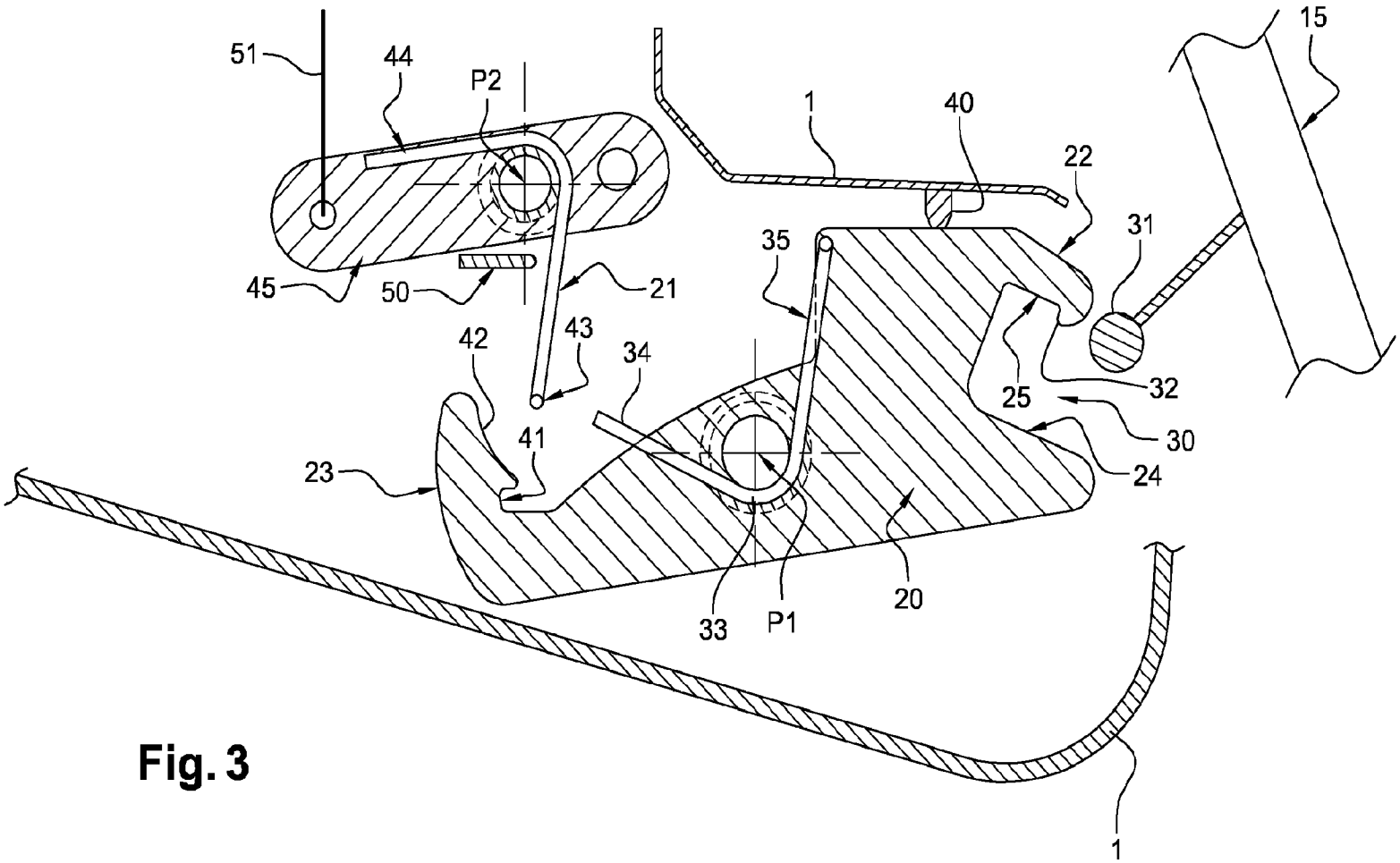
FIG. 3 is a profile view of a detail in FIG. 2.

As shown in FIG. 3, the latch 20 has a first end 22 and a second end 23. The first end 22 comprises a bearing surface 24 and a blocking surface 25 of the guard rail 15, as seen in FIG. 2.

The bearing surface 24 and the blocking surface 25 are arranged relative to each other so as to delimit therebetween a first housing 30 for receiving a guard rail member, for example a pin 31. The pin 31 is here fastened to a footboard of the guard rail 15.

According to the embodiment described and illustrated in FIG. 2, the blocking surface 25 comprises a flange 32.

The latch 20 is connected to the seat 1 by a first pivot connection P1. It is therefore rotatably movable relative to the seat 1, between a position to receive the guard rail in which the bearing surface 24 is located across the descending trajectory of the pin 31 (that is to say, across the trajectory of the pin 31 when the guard rail 15 is moved from its raised position to its lowered position) and also in which the blocking surface 25 is spaced away from the trajectory of the pin 31, and a blocking position of the guard rail 15 in which the blocking surface 25 is located across the ascending trajectory of the pin 31 (that is to say, across the trajectory of the pin 31 when the guard rail 15 is moved from its lowered position to its raised position).

The latch 20 may have a stable equilibrium position corresponding to its receiving position. The latch 20 may also comprise return means, for example, a second torsion spring 33, intended to oppose the rotation of the latch 20 from its receiving position to its blocking position.

To this end, the second torsion spring 33 comprises an end 34 connected to the seat 1 (or intended to abut against a stop piece integral with the seat 1) and an end 35 connected to the latch 20. It allows maintaining the latch 20 in a receiving position when the pin 31 is not in abutment against the latch 20.

The second torsion spring 33 may be intended to press the first end 22 of the latch 20 against the seat 1. In this case, a stop 40, fastened to the seat 1, may be provided. This stop 40 may be made of elastomer in order to absorb shocks from the first end 22 of the latch 20 against the seat 1.

The second end 23 of the latch 20 is advantageously shaped to cooperate with the first torsion spring 21 forming the locking member. Thus, the second end 23 comprises a second housing 41. It may also comprise a concave wall 42 overhanging the second housing 41.

The first torsion spring 21 forming the locking member comprises a free end 43 and an end 44 integral with a lever 45. The lever 45 is connected to the seat 1 by a second pivot connection P2. Thus, the first torsion spring 21, particularly its free end 43, is movable relative to the seat 1. The free end 43 of the first torsion spring 21 may be moved between a locking position in which it is engaged in the second housing 41 so as to immobilize the latch 20, and a unlocking position in which the free end 43 is disengaged from the second housing 41 and thus allows rotation of the latch 20 around the first pivot connection P1.

A stop 50, integral with the seat 1, may be provided on the trajectory of the free end 43 to arm the first torsion spring 21 and block its free end 43 in a locking position.

According to the embodiment described, the mechanical locking means comprise means for controlling the locking member, that is to say, the first torsion spring 21. The control means are intended to move the free end 43 of the first torsion spring 21 in a locking or unlocking position of the latch 20 and therefore the guard rail 15.

The control means here comprise the lever 45, a traction member, for example a cable 51, and a movable control member connected to the hanger 12 of the seat 1.

As shown in FIG. 2, the movable control member is formed by a control latch 52 connected to the hanger 12 by a third pivot connection P3. The control latch 52 has a first end 53 to which the cable 51 is fixed, and a second end 54 comprising a bearing member, e.g. a roller 55 pivotally mounted on the second end 54.

The cable 51 may be a mechanical control cable. It is also connected to the lever 45.

The control latch 52 may be moved between a traction position allowing, by means of the cable 51 and the lever 45, to place the free end 43 of the first torsion spring 21 in the locking position, and a rest position in which the free end 43 of the first torsion spring 21 is in the unlocking position.

The hanger 12 may comprise a stop 60 intended to stop the stroke of the control latch 52 when it arrives in a traction position, as seen in FIG. 2.

Figure 4:
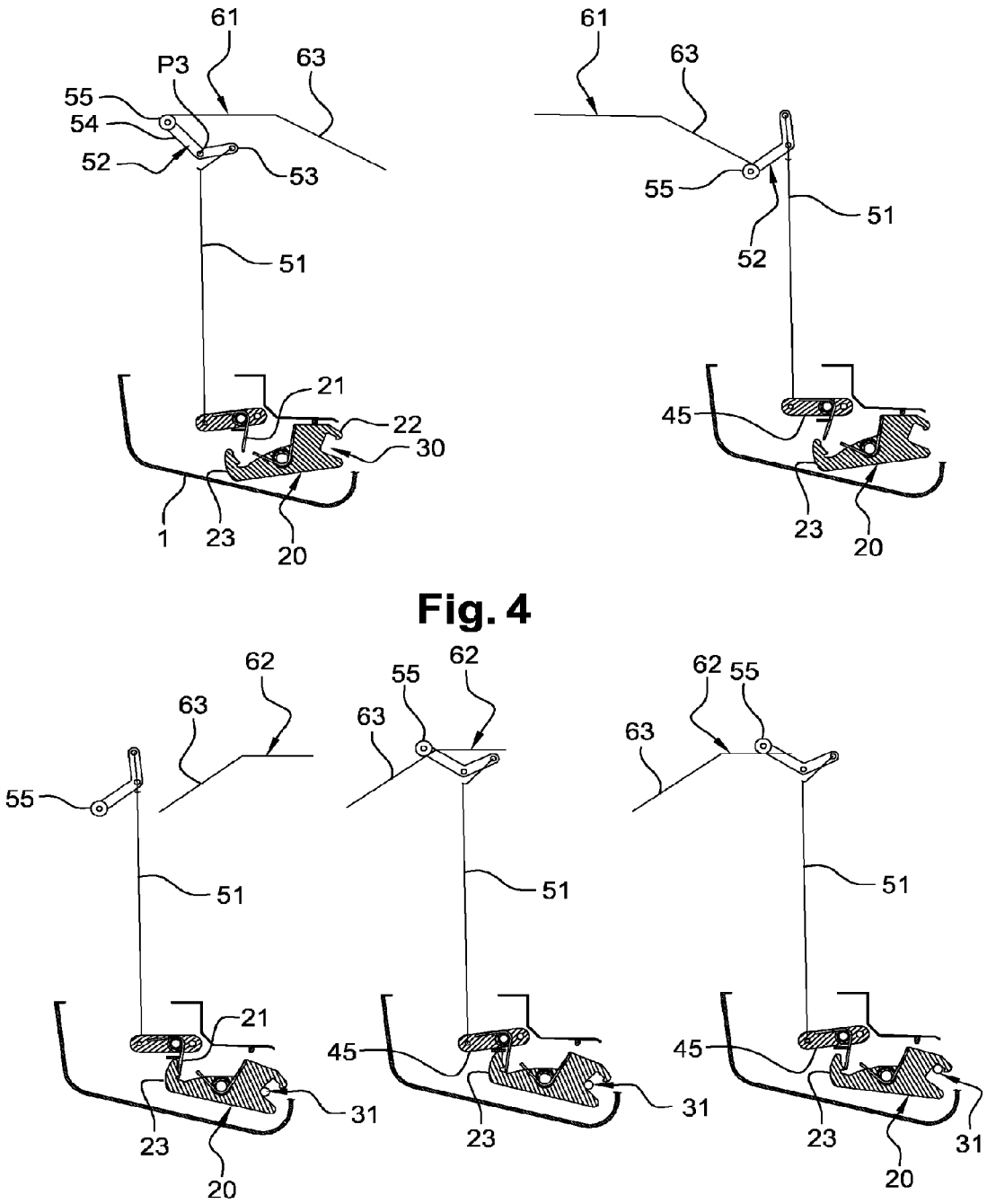
FIG. 4 is a set of schematic views of a mechanical lift vehicle according to one embodiment, in various successive stages of operation.

The second end 54 of the control latch 52, more precisely the roller 55, is intended to abut successively against a first ramp 61 and a second ramp 62, as seen in FIG. 4. The first ramp 61 and the second ramp 62 are fastened to the fixed structure of the mechanical lift facility 2.

The first ramp 61 is shaped to cause movement of the control latch 52 from its rest position to its traction position. In other words, the first ramp 61 is shaped to cause movement of the free end 43 of the first torsion spring 21 into the locking position of the latch 20.

The second ramp 62 is shaped to cause movement of the latch connected to the hanger 12 from its traction position to its rest position. In other words, the second ramp 62 is shaped to cause movement of the free end 43 of the first torsion spring 21 into its unlocking position of the latch 20.

The first ramp 61 and the second ramp 62 may thus comprise an oblique portion 63 forcing the roller 55 and thereby leading the control latch 52 to pivot from a rest position to a traction position or reciprocally as the roller 55, driven by the movement of the seat 1, moves forward against said fixed oblique portion 63.

The first ramp 61 and the second ramp 62, in particular their oblique portion 63, are placed on the trajectory of the second end 54 of the control latch 52, more precisely on the trajectory of the roller 55. As shown in FIG. 4, the first ramp 61 is arranged so that the roller 55 abuts and rolls under this first ramp 31; the second ramp 62 is arranged so that the roller 55 abuts and rolls on this second ramp 62.

The roller 55 is intended to roll alternately against the first ramp 61 and against the second ramp 62. In other words, by moving with seat 1, the roller 55 first encounters for example the first ramp 61 and, subsequently, during its movement with the seat 1, the second ramp 62. It then encounters again the (or another) first ramp 61 before it abuts against the (or another) second ramp 62, and so on.

As shown in FIG. 1, the second ramp 62 may be disposed at the exit of each boarding area 5 and the first ramp 61 may be disposed at the entrance of each disembarking area 10.

In the embodiment described, the latch 20 and the lever 45 with the first torsion spring 21 are disposed under the seat 1.

According to another aspect of the present disclosure, it also relates to the mechanical lift facility 2 comprising at least one seat 1 according to the embodiment previously described.

The mechanical lift facility 2 may also comprise at least one first ramp 61 and at least one second ramp 62 as described above and intended to cooperate with the seat 1.

The operation of the mechanical lift seat 1 according to the embodiment described above is described below with reference to FIG. 4.

In an initial situation, the mechanical lift seat 1 is for example located in the boarding area 5 of one of the end stations 3, 4. The guard rail 15 is raised to allow one or more passengers to board on the seat 1. The latch 20 is in a position to receive the guard rail 15. The first housing 30 may therefore receive the guard rail 15 when the latter is lowered. The free end 43 of the first torsion spring 21 is in the unlocking position; therefore, the first torsion spring 21 is not armed to immobilize the latch 20. Finally, the control latch 52, connected to the hanger 12 is in a rest position. In other words, the first end 53 of the control latch 52 does not exert any traction on the cable 51 likely to raise the lever 45.

The actuation of the pulleys 13, 14 causes the movement of the cable 11 of the mechanical lift facility 2, to which the seat 1 is suspended. The seat 1 thus starts moving.

The seat 1 moves from the boarding area 5 of the end station 3, 4, in which it is located towards the disembarking area 10 of the other end station 3, 4.

When it arrives at the exit of the disembarking area 5, the roller 55 abuts under the first ramp 61. When the roller 55 arrives against the oblique portion 63 of the first ramp 61, it is forced to lower, which causes rotation of the control latch 52 around the third pivot connection P3. The control latch 52 thus pivots as the roller 55 rolls under the first ramp 61, until it occupies its traction position. At this stage, the roller 55 has finished rolling under the oblique portion 63 of the first ramp 61.

By pivoting, the control latch 52 necessarily leads to the movement of its first end 53, to which the cable 51 is connected. Thus, the control latch 52, by pivoting, led to the cable 51 traction.

The other end of the cable 51 being connected to the lever 45, the pivot of the control latch 52 has also simultaneously caused rotation of the lever 45 around the second pivot connection P2, when the roller 55 passes under the oblique portion 63 of the first ramp 61.

By moving, the lever 45 causes movement of the first torsion spring 21 and, therefore, the free end 43. Movement of the lever 45 is such that it allows placing the free end 43 in the locking position. During its movement, the free end 43 comes in abutment against the stop 50. The first torsion spring 21 is thus armed. Its free end 43 is in the locking position.

During movement of the seat 1, the passenger(s) lower(s) the guard rail 15 from its raised position to its lowered position. During movement of the guard rail 15, the pin 31 comes in abutment against the bearing surface 24. This causes rotation of the latch 20 around the first pivot connection P1, until the guard rail 15 stops in the lowered position.

The rotation of the latch 20 causes movement of its second end 23, the concave wall 42 of which encounters the free end 43. The free end 43, abutting against the concave wall 42, bends and slides on said concave wall 42, towards the second housing 41.

When the guard rail 15 actually arrives in a lowered position, the free end 43 is engaged in the second housing 41, which prevents reverse rotation of the latch 20. The latch 20 is then in a blocking position.

Indeed, rotation of the latch 20 has caused movement of its first end 22 so that the blocking surface 25 is positioned across the trajectory of the pin 31, after having let it pass. Consequently, the pin 31 is now trapped in the first housing 30. At this stage, the passenger(s) cannot raise the guard rail 15, since the latch 20 cannot rotate because of the engagement of the free end 43 in the second housing 41, and the blocking surface 25 blocks the pin 31.

At the entrance of the disembarking area 10, the roller 55 comes in abutment against the second ramp 62. The roller 55, rolling on the oblique portion 63 of the second ramp 62, causes reverse rotation of the control latch 52. In other words, the control latch 52 pivots from the traction position, in which it had remained from the exit of the first ramp 61, to its rest position. At the exit of the second ramp 62, the control latch 52 is in the rest position.

Consequently, the first end 53 ceases to maintain the cable 51 tensioned. The lever 45 pivots relative to the second pivot connection P2 and lowers. By lowering, the lever 45 drives the first torsion spring 21. The free end 43 of the first torsion spring 21 disengages from the second housing 41 in which it has been housed so far.

Therefore, raising of the guard rail 15 by the passenger(s) to disembark from the seat 1 causes the abutment of the pin 31 against the blocking surface 25. As the latch 20 is no longer immobilized by engagement of the free end 43 in the second housing 41, movement of the guard rail 15 from its lowered position to its raised position causes rotation of the latch 20. The blocking surface 25 is raised by the pin 31 and deviates from the trajectory of the latter; the guard rail 15 may reach its raised position.

When the cable 11 from which the seat 1 is suspended forms a loop, the seat 1 continues to move in the end station 3, 4, from the disembarking area 10 to the boarding area 5 of the end station 3, 4. The guard rail 15 may again be locked in the lowered position as described above, and so on.

Of course, the disclosure is not limited to the embodiment described above, this embodiment having been given only as an example. Modifications remain possible, particularly from the point of view of the construction of the various members or by substitution of technical equivalents, without actually departing from the scope of protection of the disclosure.

Thus, the second torsion spring may be replaced for example by a traction or a compression spring.

The invention claimed is:

1. A mechanical lift vehicle comprising a guard rail intended to occupy a lowered position delimiting a closed space that prevents a passenger from falling and a raised position in which the guard rail opens up the space at the front of the vehicle to allow a passenger to board and disembark, and a locking mechanism configured to lock the guard rail in a lowered position, wherein the locking mechanism comprises a latch having a first end, wherein the first end comprises a bearing surface and with a locking surface, the bearing surface and the locking surface delimiting a first housing intended to accommodate part of the guard rail, and a second end, the locking mechanism further including a locking member configured to engage and to immobilize the second end of the latch when the guard rail is in the lowered position.

2. The mechanical lift vehicle according to claim 1, wherein the second end comprises a second housing configured to cooperate with the locking member.

3. The mechanical lift vehicle according to claim 2, wherein the locking member is movable relative to the vehicle and comprises a first torsion spring having a free end intended to engage the second housing.

4. The mechanical lift vehicle according to claim 3, wherein a stop is arranged on the trajectory of the free end.

5. The mechanical lift vehicle according to claim 1, wherein the locking mechanism comprises a control unit configured to control the locking member.

6. The mechanical lift vehicle according to claim 5, wherein the control unit comprises a lever fastened to the locking member, a movable control member connected to a hanger of the vehicle, and a mechanical control cable connected to the lever and to the movable control member.

7. The mechanical lift vehicle according to claim 6, wherein the movable control member comprises a control latch having a first end on which the mechanical control cable is fixed and a second end on which a bearing member is fastened.

8. The mechanical lift vehicle according to claim 1, wherein the first end of the latch forms a hook.

9. The mechanical lift vehicle according to claim 1, wherein the latch comprises a return member configured to maintain the latch in a position to receive the guard rail member in which the first housing is configured to receive the guard rail member.

10. The mechanical lift vehicle according to claim 1, wherein the latch is located under the vehicle.

11. A mechanical lift facility comprising a mechanical lift vehicle according to claim 1.

12. The mechanical lift facility according to claim 11, comprising at least one first ramp and at least one second ramp fastened to a fixed structure of the mechanical lift facility intended to actuate the control unit configured to control the locking member.

13. The mechanical lift facility according to claim 12, wherein each first ramp and each second ramp comprise at least one oblique portion configured to actuate the control unit.

* * * * *